United States Patent [19]

Ogle, II

[11] Patent Number: 5,060,812

[45] Date of Patent: Oct. 29, 1991

[54] MEDICATION CONTAINER STOPPER WHICH CAN BE PUNCTURED BY NOZZLE OF A HYPODERMIC SYRINGE

[75] Inventor: George B. Ogle, II, Alta Loma, Calif.

[73] Assignee: International Medication Systems, Limited, South El Monte, Calif.

[21] Appl. No.: 578,746

[22] Filed: Sep. 6, 1990

[51] Int. Cl.[5] ..... B65D 39/00

[52] U.S. Cl. ..... 215/247; 215/355; 215/DIG. 3

[58] Field of Search ..... 215/355, 247, DIG. 3, 215/249, 294, 296, 358

[56] References Cited

U.S. PATENT DOCUMENTS

| | | | |
|---|---|---|---|
| 2,906,423 | 9/1959 | Sandhage | 215/249 |
| 3,870,183 | 3/1975 | Luczkiw | 215/247 |
| 4,193,402 | 3/1980 | Rumpler | 215/247 |
| 4,492,634 | 1/1985 | Villa-Real | 215/247 |
| 4,664,275 | 5/1987 | Kasai et al. | 215/247 |
| 4,737,144 | 4/1988 | Chosksi | 604/263 |
| 4,863,049 | 9/1989 | Suzuki et al. | 215/249 |
| 4,872,572 | 10/1982 | Schrooten | 215/247 |

*Primary Examiner*—Stephen Marcus
*Assistant Examiner*—Paul Schwarz
*Attorney, Agent, or Firm*—Christie, Parker & Hale

[57] ABSTRACT

A medication container stopper includes an elastomeric plug which makes a friction fit in an opening of the container. A first cavity in an exterior surface of the plug opens and diverges away from an interior surface of the plug. A second cavity opens qnd diverges away from the exterior surface of the plug. The bottoms of the cavities are spaced apart to define opposite faces of a thin diaphragm formed integrally with the plug. One of the cavities has an elongated groove with a bottom which defines one face of the diaphragm, which is of a thickness that permits the diaphragm to be ruptured by inserting a conventional hypodermic syringe nozzle into the cavity in the exterior surface of the plug.

4 Claims, 3 Drawing Sheets

MEDICATION CONTAINER STOPPER WHICH CAN BE PUNCTURED BY NOZZLE OF A HYPODERMIC SYRINGE

BACKGROUND OF THE INVENTION

This invention relates to stoppers for sealing medication containers from which medication is drawn into a syringe.

Many prior art patents disclose medication containers sealed by stoppers adapted to be pierced by hypodermic needles or sharp spikes to permit access to the medication in the container. The following U.S. patents are examples of such prior art:

| U.S. Pat. No. | Inventor | Issue Date |
|---|---|---|
| 2,908,274 | Bujan | 1959 |
| 3,378,008 | Ogle | 1968 |
| 3,941,171 | Ogle | 1976 |
| 4,089,432 | Crankshaw et al | 1978 |
| 4,274,543 | Braymer, Jr. et al | 1981 |
| 4,392,851 | Elias | 1983 |
| 4,516,967 | Kopfer | 1985 |
| 4,552,277 | Richardson et al | 1985 |
| 4,863,049 | Suzuki et al | 1989 |
| 4,869,384 | Ogle, II | 1989 |

The hypodermic needles or sharp spikes are dangerous because of possible unintended finger and hand punctures from accidental contact with the sharp points of those devices. Such punctures can result in possible exposure to hazardous drugs, or to dangerous viruses, such as hepatitis or AIDS (acquired immune deficiency syndrome), carried by the hypodermic needle or spike.

Moreover, the hypodermic needles of the prior art devices are used for both mixing and injection of medication into a patient, a Y-site, or an intravenous (IV) bag. Accordingly, only relatively small-diameter needles can be used. That often makes withdrawal of the medication slow and difficult, especially when the medication is a powder, which must be mixed with a liquid before use. The sharp spikes of the prior art devices have large internal diameters, which make mixing faster and easier, but the large spike cannot be used on a patient, or repeatedly at a Y-site, or the like.

SUMMARY OF THE INVENTION

This invention provides an improved medication container stopper which can be punctured by the nozzle of a conventional hypodermic syringe, such as the type shown in U.S. Pat. No. 4,737,144 to Choksi (1988). After the nozzle penetrates the stopper in the medication container, medication can be loaded into the syringe, or, if necessary, liquid from a prefilled syringe can be injected into the container to mix with medication before loading the syringe for further use. Thereafter, the syringe can be connected to a safe hypodermic needle, such as the type shown in my U.S. Pat. No. 4,834,761, for injection into a Y-site or an IV bag. Alternatively, the nozzle of the hypodermic syringe can be connected to an intermittent cap (such as shown in U.S. Pat. No. 4,683,916) for direct intravenous injection. In either case, exposure to a sharp spike or needle is avoided.

Thus, this invention avoids the need to use an exposed needle or spike for penetrating a stopper to reach medication in a container. Moreover, when the medication must be administered through a conventional hypodermic needle, the medication can safely and quickly be placed in a conventional hypodermic syringe, which can thereafter be connected to the conventional hypodermic needle for direct injection into a patient. In any case, the hypodermic needle can be of relatively small diameter to minimize patient discomfort or damage to a Y-site or IV bag.

Briefly, the medication container stopper of this invention includes an elastomeric plug adapted to make a friction fit in the opening of the medication container. The plug has an exterior outer surface facing away from the container interior, and an inner surface facing toward the container interior. A cavity in the exterior surface of the plug opens and diverges away from the interior surface of the plug. A cavity in the interior surface of the plug opens and diverges away from the exterior surface of the plug. Each cavity has a bottom, and the bottoms of the cavities are spaced apart so they are separated by, and define opposite faces of, a thin diaphragm formed integrally with the plug. One of the cavities has an elongated groove with a bottom which defines one face of the diaphragm. The bottom of the groove is substantially parallel to the other face of the diaphragm, which is of a thickness that permits the diaphragm to be ruptured by inserting a conventional hypodermic syringe nozzle into one of the cavities.

In one form of the invention, one cavity is conical with a small, circular bottom overlying the midportion of the groove in the other cavity. In another form of the invention, each cavity has an elongated groove with a bottom which defines a respective face of the diaphragm.

Preferably, the exterior surface of the plug has an annular recess surrounding the cavity in the exterior surface of the plug to receive the collar of a conventional Luer-lock hypodermic syringe. The annular recess makes the stopper "universal" because that embodiment of the stopper can be used with collarless tapered nozzles on hypodermic syringes, or on hypodermic syringes which include a Luer-lock collar around the tapered nozzle of the syringe. U.S. Pat. No. 4,737,144 to Choksi shows a conventional hypodermic needle locked to a tapered syringe nozzle by a Luer-lock collar.

Preferably, the cavity with the groove diverges at an increasing rate with distance from the diaphragm.

The elastomeric material is preferably a butyl rubber compound with a Shore hardness of between about 50 and about 55.

The diaphragm is preferably between about 0.005" and about 0.020" thick. The length of the elongated groove is between about 5 and about 15 times the thickness of the diaphragm. The groove is between about 5 and about 15 times longer than it is wide.

These and other aspects of the invention will be more fully understood from the following detailed description, taken in conjunction with the accompanying drawings.

DETAILED DESCRIPTION

Figure 1:
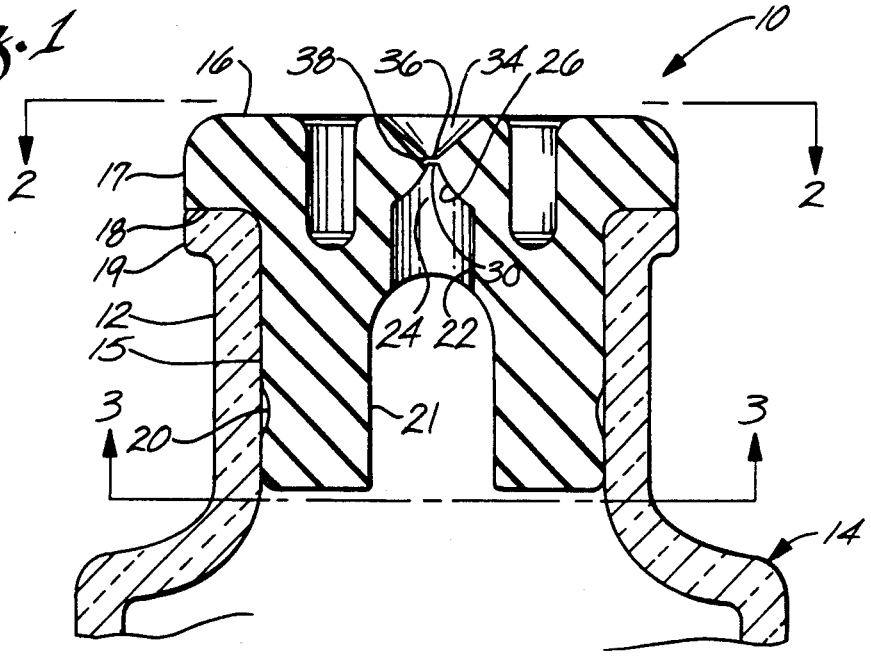
FIG. 1, a sectional view taken on line 1—1 of FIG. 2, shows one of the preferred embodiments of a stopper of this invention disposed in the mouth of a glass medication container.
Figure 2:
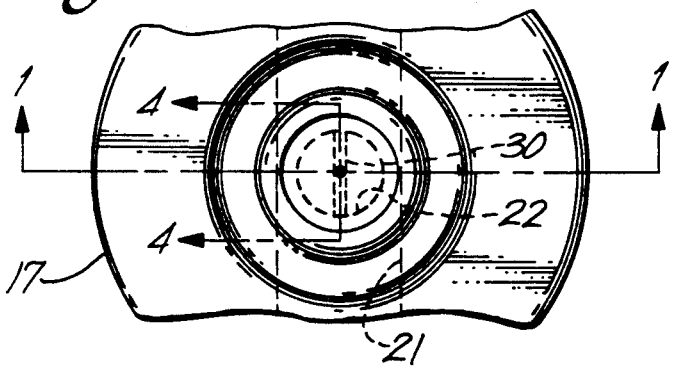
FIG. 2, an elevational view taken on line 2—2 of FIG. 1, shows the exterior surface of the stopper.

Referring to FIGS. 1–4, a stopper 10 of an elastomeric material, such as a butyl rubber compound, and preferably having a Shore hardness between about 50 and about 55, is sealed in the mouth 12 of a conventional medication container or bottle 14.

The stopper includes an elongated cylindrical plug 15 with an upper, exterior surface 16 and an outwardly extending annular flange 17 formed integrally with the upper end of the plug. A downwardly facing annular surface 18 on the flange fits against an annular lip 19 around the mouth of the container. The plug makes a snug friction fit in the mouth of the container. An annular, outwardly opening groove 20 around the exterior circumference of the lower or inner end of the plug facilitates a hermetic seal with the container. A downwardly opening U-shaped slot 21 in the lower end of the plug makes it possible to use the stopper with medication which is vacuum-dried before the stopper is seated in the position shown in FIG. 1. Such a stopper is sometimes referred to as a lyophilizing stopper, but this invention is not limited to such stoppers.

A vertical cylindrical bore 22 extends upwardly from the upper end of the U-shaped slot 21, and merges at its upper end with the outer periphery of a downwardly diverging cavity 24 which has sidewalls 26 that are slightly convex, so the cavity 24 opens and diverges away from the exterior surface of the plug at an increasing rate with distance from the plug exterior surface.

Figure 3:
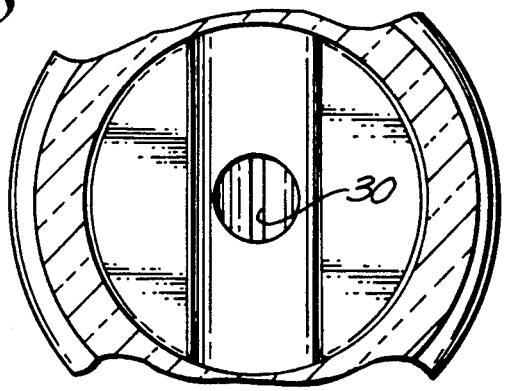
FIG. 3, a view taken on line 3—3 of FIG. 1, shows the interior surface of the stopper.
Figure 4:
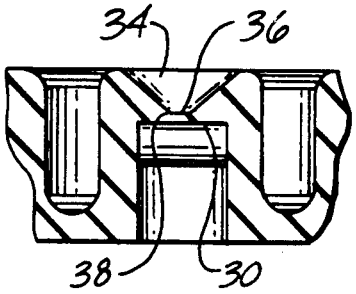
FIG. 4, a fragmentary view taken on line 4—4 of FIG. 2, shows how the two cavities define the diaphragm.

Referring to FIGS. 1, 3, and 4, an elongated rectangular groove 30 forms the bottom, or inner limit, of cavity 24 and extends in a direction parallel to the exterior surface of the plug. Preferably, the groove is between about 5 and about 15 times longer than it is wide.

An upwardly diverging conical cavity 34 centered in the exterior surface of the plug has a circular bottom 36 centered over the elongated groove 30. The bottom of the elongated groove 30 in the cavity 24 is spaced below the circular bottom of cavity 34 to define the respective lower and upper surfaces of a thin diaphragm 38, as shown best in FIG. 4. The areas where the circular bottom of cavity 34 overlies the midpoint of the rectangular groove 30 is the target area for a tapered nozzle 40 on a conventional hypodermic syringe 42, shown in FIG. 5.

The thickness of the diaphragm is preferably between about 0.005" and about 0.020", when using the typical elastomeric materials presently available. Ideally, the diaphragm is as thin as possible to facilitate rupturing, and yet has the required thickness to be substantially impervious to air and maintain the contents of the container sterile. Preferably, cavity 34 is a right circular cone with a maximum angle at the apex of about 90°, as shown in FIG. 1. Preferably, the elongated groove is between about 5 and about 15 times longer than the thickness of the diaphragm.

An outwardly opening, annular recess 44 is disposed concentrically around cavity 34. The purpose of annular recess 44 is described below with respect to FIG. 6.

Figure 5:
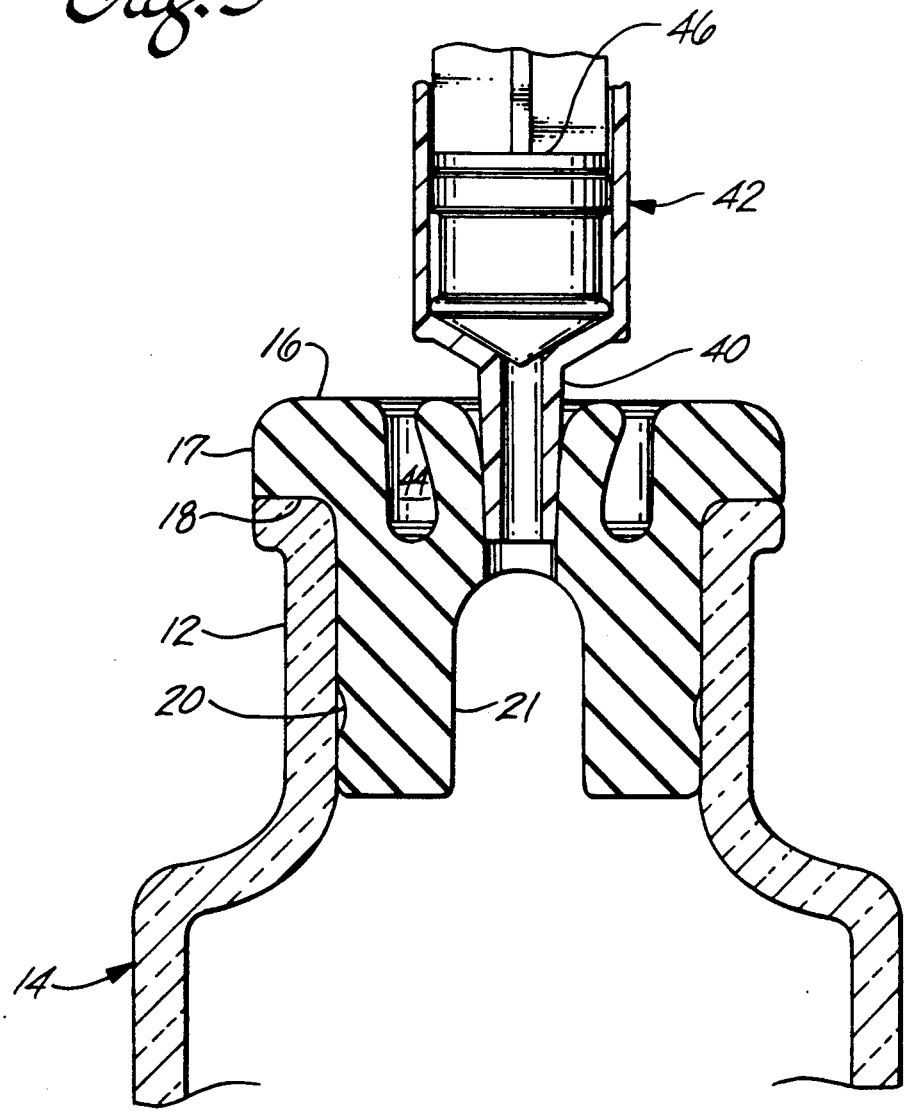
FIG. 5, a sectional view similar to FIG. 2, shows the diaphragm ruptured by a hypodermic syringe nozzle.

FIG. 5 shows the stopper of FIGS. 1–4 penetrated by the nozzle 40 of a conventional hypodermic syringe 42. The relatively blunt outer end of nozzle 40 presents no hazard with respect to accidental puncturing of the skin of one using the syringe and stoppered container. To puncture the stopper, the container is grasped firmly in one hand, the tapered nozzle 40 of the syringe is centered in the cavity 34, and then pushed through cavity 34 with a twisting motion, causing the diaphragm to rupture and permitting the nozzle to penetrate into cavity 24, as shown in FIG. 5. The resilient character of the plug causes it to make a snug, liquid-tight seal around the tapered nozzle. If the medication (not shown) in the container is ready for use, the assembly shown in FIG. 5 is inverted so that the exterior surface of the stopper faces downwardly. A conventional piston 46 in the hypodermic syringe is moved away from the nozzle 40, causing medication to be drawn into the syringe. If the medication in the container is in powder form, or otherwise requires mixing with a liquid, the syringe is preloaded with the required liquid (not shown), which is surged back and forth into the container for proper mixing. Thereafter, the medication is drawn into the syringe, and used as required.

Even though the diaphragm is thick enough to prevent contamination of the container contents by diffusion from the surrounding atmosphere, the unique combination of the cavities in defining the diaphragm permits it to be ruptured, rather than merely stretched, as the nozzle is inserted. Moreover, after the diaphragm is ruptured, no loose particles of the stopper material are formed to contaminate the medication.

Figure 6:
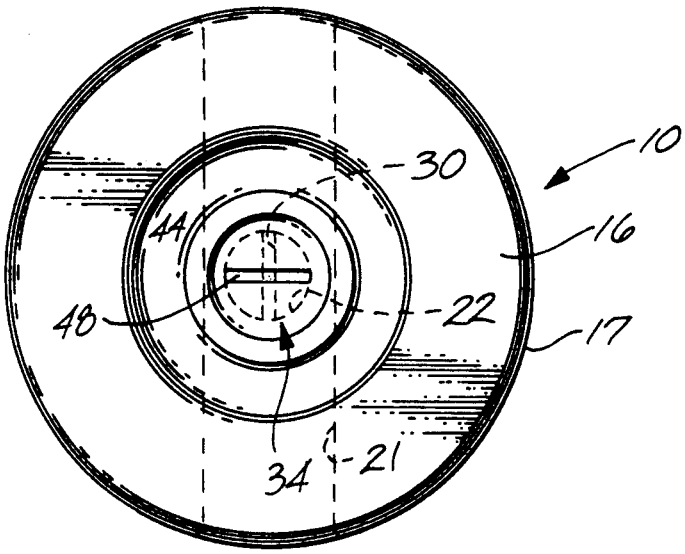
FIG. 6 is an elevational view of the exterior surface of another embodiment of the stopper in which an elongated groove is formed in the bottom of each cavity, with the grooves being mutually perpendicular.

FIG. 6 shows another embodiment of the stopper, which is identical with that shown in FIGS. 1–5, except that the bottom of cavity 34 in the exterior surface of the stopper includes a elongated, rectangular groove 48 extending across the bottom of cavity 34. With the embodiment shown in FIG. 6, the diaphragm (not shown) is formed between the respective bottoms of the two rectangular grooves where they overlap. The rectangular grooves show in FIG. 6 are mutually perpendicular. Alternatively, the rectangular grooves are parallel.

Figure 7:
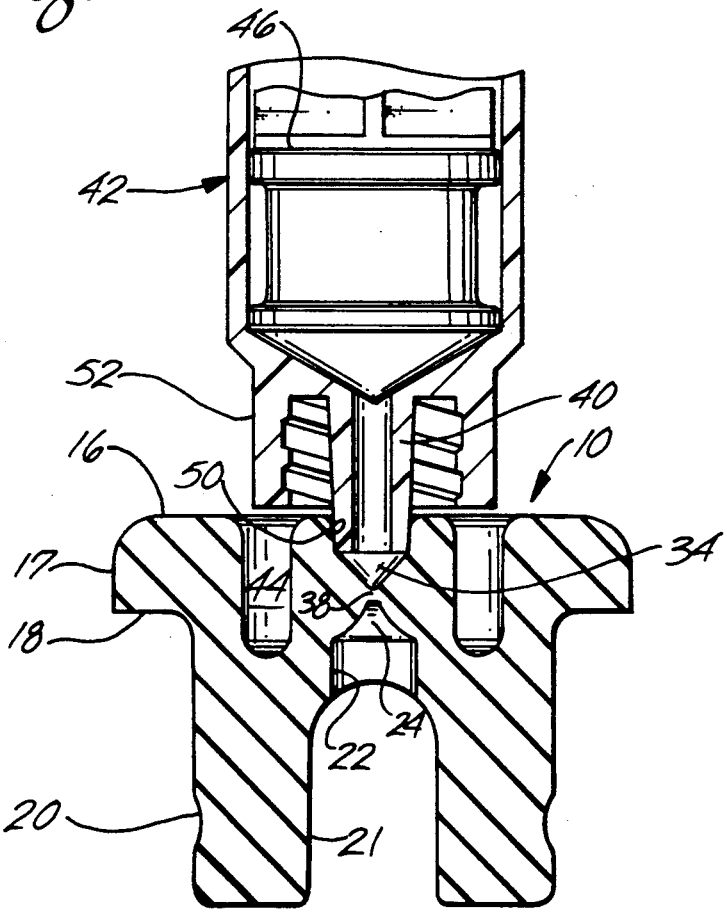
FIG. 7 is a sectional view of another preferred embodiment of the stopper of this invention.

FIG. 7 is a sectional view of another embodiment of the stopper of this invention, which is similar to the embodiment shown in FIGS. 1–5, except that in the embodiment of FIG. 7, a central cylindrical bore 50 extends inwardly from the exterior surface of the plug to merge with cavity 34. The cylindrical bore 50 guides the leading end of nozzle 40 to be centered on the target area in the bottom of cavity 34. The syringe 42, shown in FIG. 7, includes a conventional annular Luer-lock collar 52 around the nozzle 40. As the nozzle 40 is inserted into bore 50 and cavity 34 to rupture the diaphragm 38, the leading end of the Luer-lock collar 52 fits into the annular recess 44 opening out of the exterior surface of the stopper. Thus, the annular recess 44 makes the stopper "universal" in the sense that it can be used with a collarless hypodermic syringe (such as shown in FIG. 5), or with a hypodermic syringe which includes the Luer-lock collar shown in FIG. 7.

I claim:

1. An elastomeric stopper for a medication container, the stopper comprising:

an elastomeric plug adapted to make a friction fit in an opening of the medication container, the plug having an exterior surface adapted to face away from the container interior and an interior surface adapted to face toward the container interior, the exterior surface of the plug having a cavity which opens and diverges away from the interior surface of the plug, the interior surface of the plug having a cavity which opens and diverges away from the exterior surface of the plug, each cavity having a bottom, the bottoms of the cavities being spaced apart so they are separated by, and define opposite faces of, a thin diaphragm formed integrally with the plug, one of the cavities having an elongated groove with a bottom which defines one face of the diaphragm, the bottom of the groove being substantially parallel to the other face of the diaphragm, and the diaphragm being of a thickness which permits the diaphragm to be ruptured by inserting a hypodermic syringe nozzle into one of the cavities; and a cylindrical bore extending from the exterior surface of the plug into the plug to merge with an outer portion of the cavity in the exterior surface of the plug to provide a guide for the nozzle of the hypodermic syringe.

2. An elastomeric stopper for a medication container, the stopper comprising:

an elastomeric plug adapted to make a friction fit in an opening of the medication container, the plug having an exterior surface adapted to face away from the container interior and an interior surface adapted to face toward the container interior, the exterior surface of the plug having a cavity which opens and diverges away from the interior surface of the plug, the interior surface of the plug having a cavity which opens and diverges away from the exterior surface of the plug, each cavity having a bottom, the bottoms of the cavities being spaced apart so they are separated by, and define opposite faces of, a thin diaphragm formed integrally with the plug, one of the cavities having an elongated groove with a bottom which defines one face of the diaphragm, the bottom of the groove being substantially parallel to the other face of the diaphragm, and the diaphragm being of a thickness which permits the diaphragm to be ruptured by inserting a hypodermic syringe nozzle into one of the cavities; and a transverse slot in the interior surface of the plug and a bore extending from an inner edge of the transverse slot to the beginning of the cavity in the interior surface of the plug.

3. A stopper according to claim 1 or 2 in which the Shore hardness of the elastomeric plug is between about 50 and about 55.

4. A stopper according to claim 1 or 2 in which the diaphragm is between 0.005″ and about 0.020″ thick.

* * * * *